United States Patent [19]

Thompson

[11] Patent Number: 4,660,495

[45] Date of Patent: Apr. 28, 1987

[54] FLOATING DOCK/MARINA SYSTEM

[76] Inventor: Thomas L. Thompson, 1515 E. Ocean Blvd., Balboa, Calif. 92661

[21] Appl. No.: 774,232

[22] Filed: Sep. 9, 1985

[51] Int. Cl.[4] ..... B63B 35/72

[52] U.S. Cl. ..... 114/263; 405/219

[58] Field of Search ..... 114/258, 263, 264, 266, 114/267, 201 R, 358; 405/218, 219

[56] References Cited

U.S. PATENT DOCUMENTS

| | | | |
|---|---|---|---|
| 3,012,533 | 12/1961 | Tellefsen | 114/267 |
| 3,024,753 | 3/1962 | Benson | 114/263 |
| 3,053,216 | 9/1962 | Benson | 114/263 |
| 3,073,274 | 1/1963 | Lamb | 405/219 |
| 3,103,019 | 9/1963 | Freire | 114/358 |
| 3,448,709 | 6/1969 | Hardwick | 114/266 |
| 3,730,128 | 5/1973 | Burwell | 114/201 R |
| 4,223,629 | 9/1980 | Dunlop | 114/203 |
| 4,252,470 | 2/1981 | Sluys | 114/263 |
| 4,260,293 | 4/1981 | Peterson | 114/267 |
| 4,316,426 | 2/1982 | Meeusen | 114/263 |

FOREIGN PATENT DOCUMENTS

| | | |
|---|---|---|
| 642128 | 6/1962 | Canada . |
| 1025731 | 2/1978 | Canada . |
| 883692 | 7/1943 | France . |

*Primary Examiner*—Joseph F. Peters, Jr.
*Assistant Examiner*—Stephen P. Avila
*Attorney, Agent, or Firm*—Price, Gess & Ubell

[57] ABSTRACT

An improved floating dock/marina system having a monocoque-type frame structure. The embodiments disclosed include a dock structure defined by a main walkway section and a plurality of extended finger sections which are formed having longitudinal side-beam members, known as walers, that are interconnected by a plurality of spaced, transverse, beam members and a longitudinal center-beam structure. Various arrangements are provided for the beam structure, the transverse beam members and/or the longitudinal center-beam structure being formed having a height greater than the height of the waler side-beam members, whereby a crowning arrangement is defined. A decking is employed which comprises sheets of plywood which are attached to the framework. The crowning arrangement creates a central raised portion in the deck, the opposite sides of the deck being sloped downwardly and outwardly. The bottom of the frame structure is closed by a wall to which a float device is mounted, thereby establishing the monocoque-type construction of the deck structure.

18 Claims, 9 Drawing Figures

FLOATING DOCK/MARINA SYSTEM

BACKGROUND OF THE INVENTION

1. Field of the Invention

This invention relates generally to floating docks and like structures, and more particularly to a floating-dock system having am improved monocoque construction that establishes a unique dock which includes a self-draining, walking surface.

2. Description of the Prior Art

There have been problems and difficulties associated with present state-of-the-art dock structures since they do no allow for complete drainage of a dock surface. All known floating-dock structures employ substantially flat walking surfaces or decking. Decking for dock structures is generally formed by using wooden planks placed transversely across the frame of a dock which comprises a parallel side beams. The use of wooden planks allows for good water drainage, but this type of decking is not very desirable due to its cost and the required constant maintenance.

Therefore, the trend is to provide substantially flat, continuous surfaces such as concrete slabs or large wooden plywood sheets. However, these surfaces create drainage problems since a dock will hold water in the uneven areas, thus forming many puddles or pockets of water that remain for long periods of time. This problem not only creates an inconvenience and a hazard, but also results in water damage to both concrete and wood surfaces.

As examples of several dock structures, one may refer to U.S. Pat. Nos. 3,012,533; 3,024,753; 3,053,216; 3,073,274; 3,448,709; 3,730,128; 4,223,629; 4,252,470; 4,260,293; and 4,316,426. There are also Canadian Pat. Nos. 642,128 and 1,025,731; and French Pat. No. 883,692.

SUMMARY OF THE INVENTION

In order to solve the problems described above, the applicant has designed a unique frame-and-surface structure, the combination of which provides a marine-dock assembly having a sturdy, durable and non-slip deck structure which has heretofore been lacking in the art.

The present invention provides a unique plywood box-beam structure which comprises both transverse beams and longitudinal beams that intersect and interconnect each other to form the interior webbing, which defines a monocoque, floating dock/marina structure. The beams also interconnect with the outside glulam walers (longitudinal side beams) and the top and bottom plywood surface skins.

The center longitudinal joist beams accomplish several structural functions. One function is to elevate the center of the plywood deck so as to create a crown that results in a well-drained surface or decking to eliminate water puddling. The second function of the longitudinal beams is to interconnect the transverse box beams so as to increase and accentuate the torsion/stress resistance of the structure. Interposed between the transverse box beams are one or more transverse plank members. Thirdly, the beams and plank members are combined with the top and bottom surface skins to increase resistance to torsion/stress, largely because the top and bottom edges of the beams and plank members are glued to the surfaces of the top and bottom plywood skin panels. Fourth, these box beams aid in maintaining the geometry of the monocoque-surface skins to make them more effective in resisting the compression and torsion stresses imposed upon them by wind and water movement.

It is an important object of the present invention to provide a unique monocoque marina dock wherein the outer deck surface forms the top-skin member, and a lower sheet of plywood defines the bottom skin member, so that the skins and the frame members will together absorb all or most of the stresses to which the structure is subjected, in a similar manner as with an airplane fuselage or an automobile body in which the skin or outer cover bears and absorbs all or most of the stresses to which the particular body is subjected.

Another object of the invention is to provide a novel marina-dock assembly that is formed with a central longitudinal beam that creates and supports a permanent crown in the center of the decking, which is essential to achieving a well-drained, non-puddling surface.

Still another object of the present invention is to provide a marina-dock assembly of this character that is so designed that all stresses placed upon the interior frame-structure fasteners are always in a sheer direction, and only the skin panels are placed in tension and compression. Thus, this construction makes the present invention not only the strongest and most cost-effective floating dock, but it is also the most durable, since the wear-out factor from improperly applied stress has been reduced dramatically.

It is still another object of the invention to provide 2"×4" transverse planks that function to establish blocking to carry the loads at the seams between the plywood sheets that form the top and bottom surfaces of the floating-dock structures.

The transverse 2"×4" planks are placed in four-feet centers so that they fall beneath the edges of the single plywood panels that are always laid so that the four-feet width of the standard plywood sheet is always in the transverse direction. This arrangement results in the adjacent sheets of plywood coming together on approximately the center line of the 2"×4" plank, thus providing adequate surface area on the 2"×4" plank for the edges of the plywood to be fastened with proper edge distance. The fastening is accomplished by nailing or screwing on 4" centers as well as gluing the surfaces. This gluing step contributes the same strength to the wood structure that welding contributes to a metal structure. The loads are borne by the entire edge because the glue line is stronger than the wood, rather than being borne only by the fasteners. In a situation where a joint connection is properly glued and the fit is tight, the fastenings (screws or nails) do not contribute appreciable strength, but they serve principally as clamps to hold the edges of joint together tightly until the glue has dried properly. If it were not for the impracticality of doing it, the fastenings could be removed after the glue was completely set up, without losing any strength.

The effect of the top surface of the floating-dock structures, as well as the bottom surface which is covered with plywood panels that are connected together at their seams in this manner, give the structure the strength of having continuous, uninterrupted flanges that are connected to the longitudinal beams of the structure which thus define the web members of the box beam. The plywood panels which are glued and fastened to the transverse 2"×4" planks as described above are also glued and nailed or screwed along their respective edges to the top and bottom edges of the longitudinal beams.

The structure now becomes a true box beam which provides all the strength and load-carrying capability of such a structure to the unique requirements of a floating marina structure. Floating marina structures are unique and differ significantly from fixed, land-connected structures in that they must be selfcontained and cannot find strength and rigidity from connections that are anchored in the soil. The present invention is unique for the particular reason that its structures are constructed from wood (beams, planks, plywood, etc.). It would be a simple matter to build box beams from steel forms which are welded together as in the well-known fashion, but steel has no ability to withstand the corrosive effects of a salt-water environment, particularly in a marina environment where dissimilar metals and electric power are present to create severe conditions which are highly conducive to rapid deterioration from electrolysis.

Floating dock structures must resist a variety of loads which the box beam, of all structures, best resists. These loads are generated by wind forces against the berthed boats which transfer to the long, thin finger sections to which the boats are tethered. It is important to note that the width of marina structures, both finger sections and headwalk sections, must be limited in order that a maximum number of boats can be accommodated so that the owner can maximize his income from the investment. For this reason, finger sections that are strong enough to be built to long, thin dimensions are of great economic benefit.

Finger sections do not lend themselves well to having pilings placed between the point where they are secured to the headwalk section and at the far end, since a piling placed midway between these points would severely impede freedom of movement of foot traffic and interfere in other ways with the effective use of the structure. Also, the cost of added pilings is not welcomed by an owner.

In addition to the horizontal or lateral load resistance obtained by the unique monocoque design, the structure is also excellent in resisting vertical loads imposed by wind and storm waves which can reach heights as great as four to five feet within a marina site during particularly bad weather conditions. The abutting flanges represented by the top and bottom plywood continuous surfaces add considerably to the beam strength of the longitudinal beams which are the web sections. This strength enables the structure to span the distances between these wave crests without failure. It must also be kept in mind that these long, thin structures must also withstand the vectors of these loads.

There is one very difficult type of loading which is most difficult for a single, thin finger section to resist effectively, and that is torsional loading. Fingers with very poor resistance to torsional stress roll dangerously when they are walked upon and can be quite unsafe. The box-beam monocoque design provides superior resistance to these forces because the top and bottom surfaces are placed in sheer under this load circumstance, and under sheer load they resist almost perfectly.

It can be seen then that the present invention is unique in its method of solving these floating-structure problems, and at the same time provides many long-sought answers to the vexing shortcomings of wood dock structures that are built to conventional designs.

The above and other objects, features and advantages of the invention will be apparent in the following detailed description of the illustrative embodiments thereof which is to be read in connection with the accompanying drawings.

BRIEF DESCRIPTION OF THE DRAWINGS

Referring more particularly to the accompanying drawings, which are for illustrative purposes only, identical reference numerals will refer to like parts in the various views, wherein.

DESCRIPTION OF THE PREFERRED EMBODIMENT

Figures 1, 4, 5, 9:
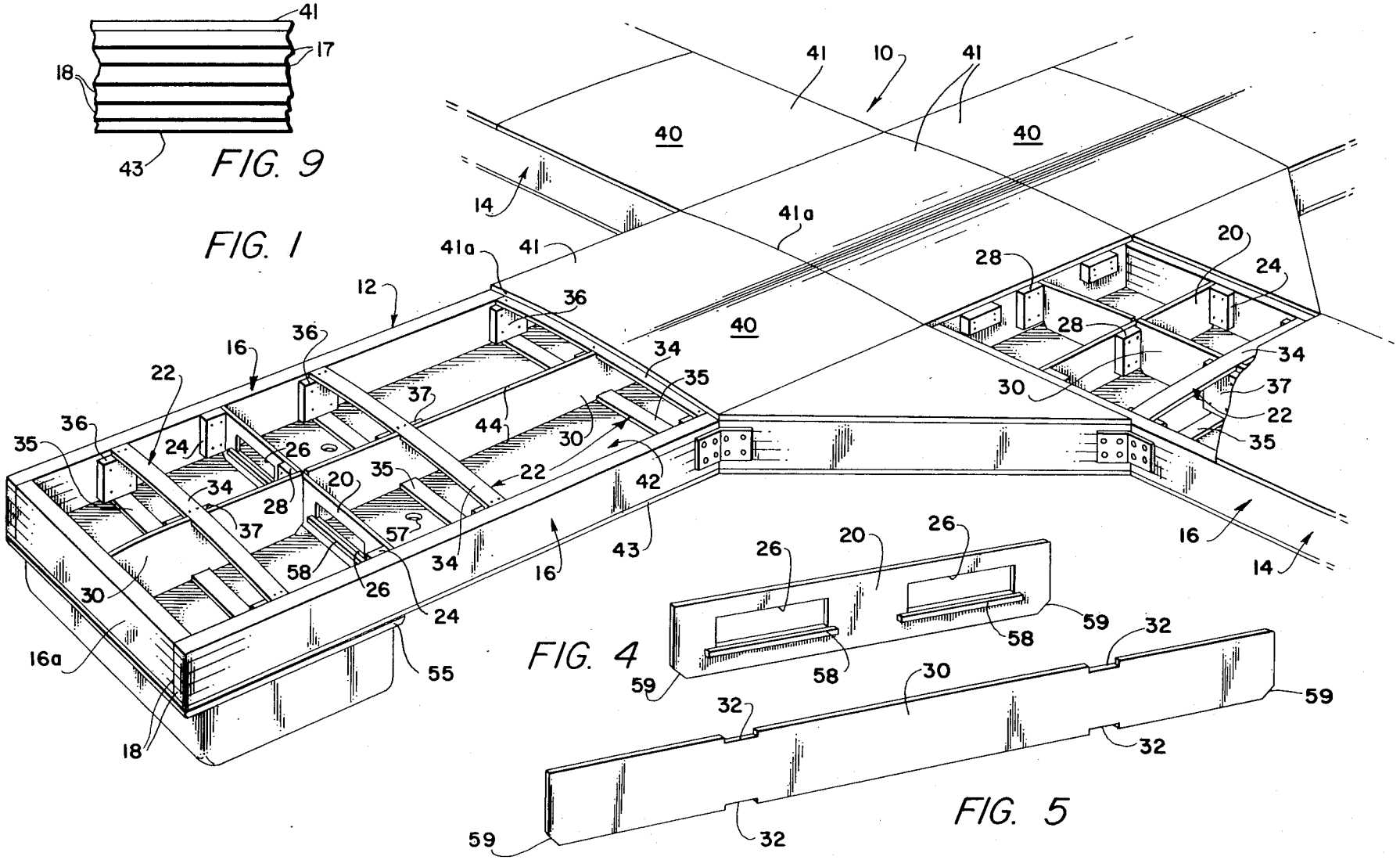
FIG. 1 is a pictorial view of a portion of a dock assembly having portions thereof broken away to more clearly illustrate the present invention.
FIG. 4 is a perspective view of a typical transverse web member associated with the main walkway section having openings for utilities formed therein.
FIG. 5 is a perspective view of a longitudinal center joist member.
FIG. 9 is a partial side view of the side beam, and upper and bottom decking.

The following is a detailed description of two related embodiments of the present invention, each of the embodiments providing a monocoque-type frame structure which defines a unique floating dock/marina, which is generally indicated at 10.

Referring more particularly to the embodiment shown in FIG. 1, there is illustrated a floating dock/marina assembly 10, hereinafter referred to as the "dock assembly". Basically, a dock assembly includes a main walkway section 12 having a plurality of finger sections 14, which extend outwardly from the walkway section and are juxtaposed to each other so as to define several boat slips.

The main walkway 12 and finger sections 14 are formed with longitudinal side beams 16, which are also referred to as "walers". Side beams 16 can be constructed from any suitable wood material, but the preferred form (as shown) is made of several individual beam members 18 which are glued together. Such a beam structure is known as a "glulam" construction. Side beams 16 are held in parallel spaced relationship by means of a plurality of transverse beam or web members 20. Transverse beams 20 are formed from a single plywood member or by plywood members glued together for greater thickness.

As seen in FIG. 1, transverse beams 20 are formed with a height that is equal to the height of side-waler beams 16. Each transverse beam is particularly spaced and arranged along sections 12 and 14 so as to be positioned on approximately eight feet centers with respect to each other, each brace means (indicated generally at 22) being arranged therebetween to establish an improved box-beam frame construction which defines a monocoque-arranged, floating, dock/marina structure made from suitable marine-type plywood and wood laminates which are rot and corrosion proof.

Figure 2:
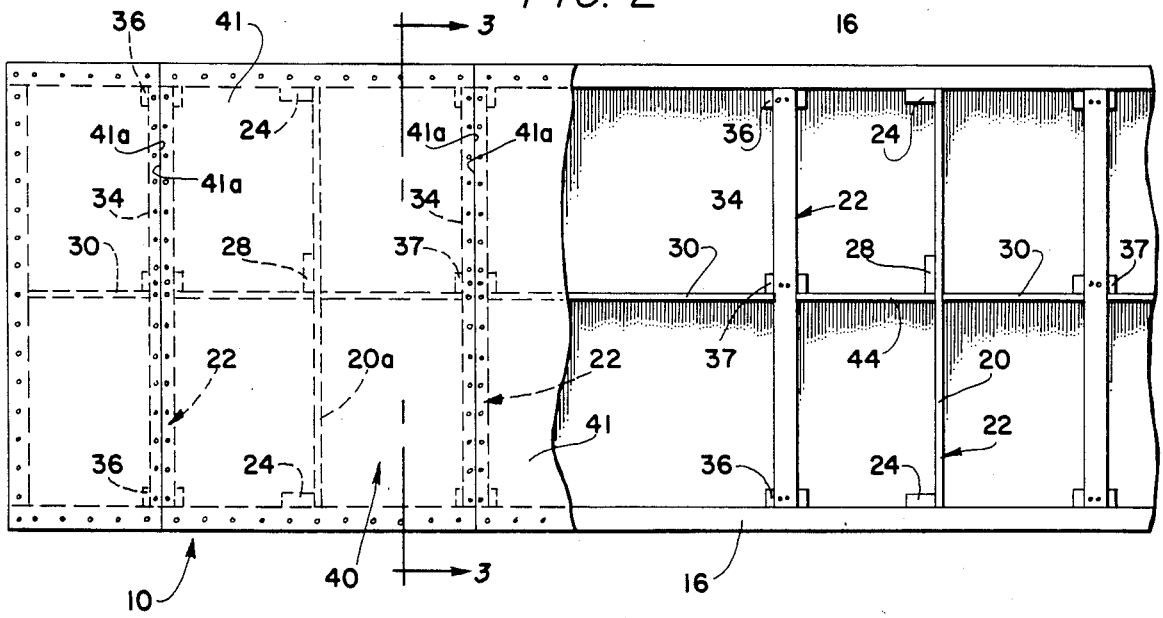
FIG. 2 is a top-plan view of one section of the dock assembly with some of the decking removed, showing the arrangement of the transverse web members and the interposed, transverse, strut members.

In forming the marina structure 10, it is preferable that the main walkway section 12 be constructed first with the finger sections 14 added thereto. The main walkway 12, as seen in FIGS. 1 and 2, is formed by outer, side, longitudinal whalers 16 having an end, transverse whaler member 16a interconnecting the oppositely disposed parallel walers 16. Once these members are in place, the transverse wood beams 20 are mounted between the side walers 16 in a suitable manner. Preferably, beam 20 comprises a pressure-treated marine plywood which is secured to fixed block or cleat members 24. Block members 24 are also formed from wood or laminated marine plywood pieces which are nailed and glued to the inner surface of the glulam side beams 16. The preferred positioning of the transverse beam or web members 20 within the frame structure is to place the first web member 20*a* approximately four feet from end waler 16*a* with the preceding web members 20b, 20*c*, etc., spaced eight feet apart. These steps are also followed when constructing finger sections 14.

The only difference between the main walkway 12 and finger sections 14 is that the widths of the main walkway 12 can vary between four, six and either feet; while the width of each finger section 14 is generally held to four feet. Further, web members 20 of the main walkway include openings 26 so as to receive and support various utility lines such as for gas, electricity and water. Web members 20 of the finger sections do not require such openings. Affixed to the central portion of each web member 20 is a mounting cleat 28 which is also nailed and glued thereto.

Once all of the transverse web members 20 are secured in place, central longitudinal joist members 30 are fixedly interposted between the parallel transverse beam or web members 20, as shown in FIGS. 1 and 2. FIG. 5 illustrates a typical, central, longitudinal joist member 30 which has a plurality of aligned notches 32 formed in the upper and lower edges thereof. It is important to note, particularly in the cross-sectional view of FIG. 3, that joist member 30 is formed having a height greater than the side-waler beams 16. This arrangement provides a means to establish a crowned walkway surface. The opposite ends of each joist member 30 are nailed and glued to cleats 28. To further define the improved, box-beam, monocoque frame structure, brace means 22 are transversely mounted between side walers 16 in parallel relationship with webs 20. Here again, both the main section and the finger sections are constructed alike.

Figure 3:
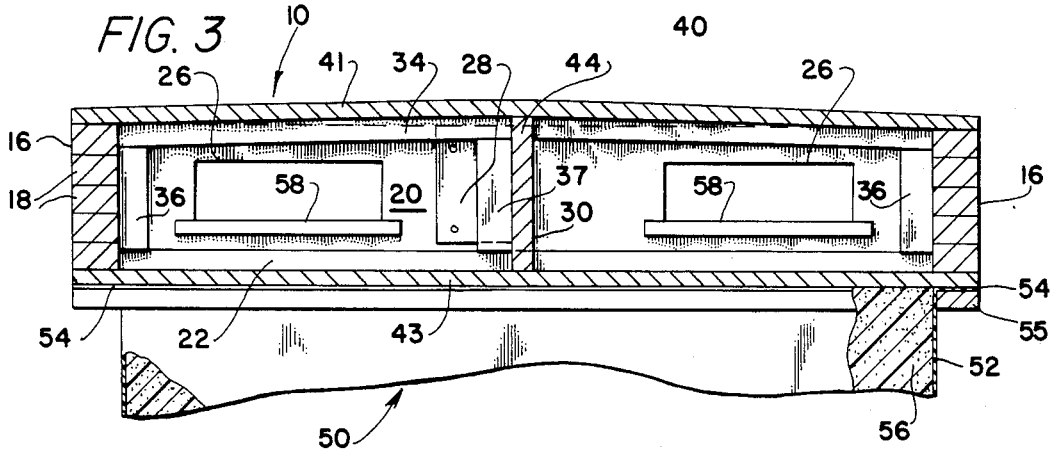
FIG. 3 is an enlarged cross-sectional view thereof taken substantially along line 3—3 of FIG. 2.

Each brace means 22 is positioned on four-feet centers with respect to each other, and are structured so as to have upper and lower strut members 34 and 35 which are preferably made of suitable 2"×4" elongated wooden planks that extend from one side waler to the other, as indicated in FIGS. 1, 2 and 3. The opposite ends of struts 34 and 35 are nailed and glued to waler cleats or blocks 36, and to joist cleats 37 which are secured in the same manner to center joist 30.

The framing is substantially completed at this point, with the exception of the decking 40 and the bottom cover 42. Decking 40 comprises a plurality of pressure-treated, marine plywood sheets 41 having at least a width of four feet and a length of either four, six or eight feet depending upon the width of the sections 12 and 14. That is, the four-feet width is equal to the four-feet center lines of the positioned brace means 20. As previously mentioned, the transverse 2"×4" strut members 34 and 35 are placed on four-feet centers so that they are positioned to support and engage the oppositely disposed edges 41*a* of the standard plywood panel which is four feet wide. Thus, the panels abut on the center line of each strut. This is also true for the bottom cover 42. These edges 41*a* are nailed and glued in place, and thus define a continuous, uninterrupted surface. The panels are also glued to edges 44 of the center longitudinal joist 30. Once glued, panels 41 of decking 40 and panels 43 of bottom cover 42 provide an unique box-beam structure normally found only in aircraft construction. FIG. 9 discloses the glue seams 17 between the upper and bottom decking and also between the individual beam members 18. Moreover, decking panels 41 are caused to be bent downwardly on opposite sides of the central joist 30, since the joist is higher than the longitudinal side walers 16. This thus defines a unique crowned decking, both on the main walkway section and on the finger sections.

Attached to the bottom cover 42 is a plurality of float means. These are several suitable float systems that can be employed; however, the preferred arrangement comprises a floatational unit 50 which is located under the structure so as to be attached to panels 43. Each rotational unit 50 comprises a polyethylene tub 52 having a peripheral flange 54. Tube 52 is filled with a polystyrene pontoon 56. In order to provide a positive secured arrangement, wood battens 55 are positioned along flanges 54 so that suitable nails and screws can be used to attach the floatational unit in its proper location under the respective sections 12 and 14.

Since there is no space between deck 40 and the transverse beams 20, there are provided openings 26 which include a support bar 58. Further, in order to allow water captured within the structure to escape, drain holes 57 are randomly located in bottom panels 43 and the bottom corners 59 of web members 20, and the transverse joist members 30 are chamfered.

Figure 7:
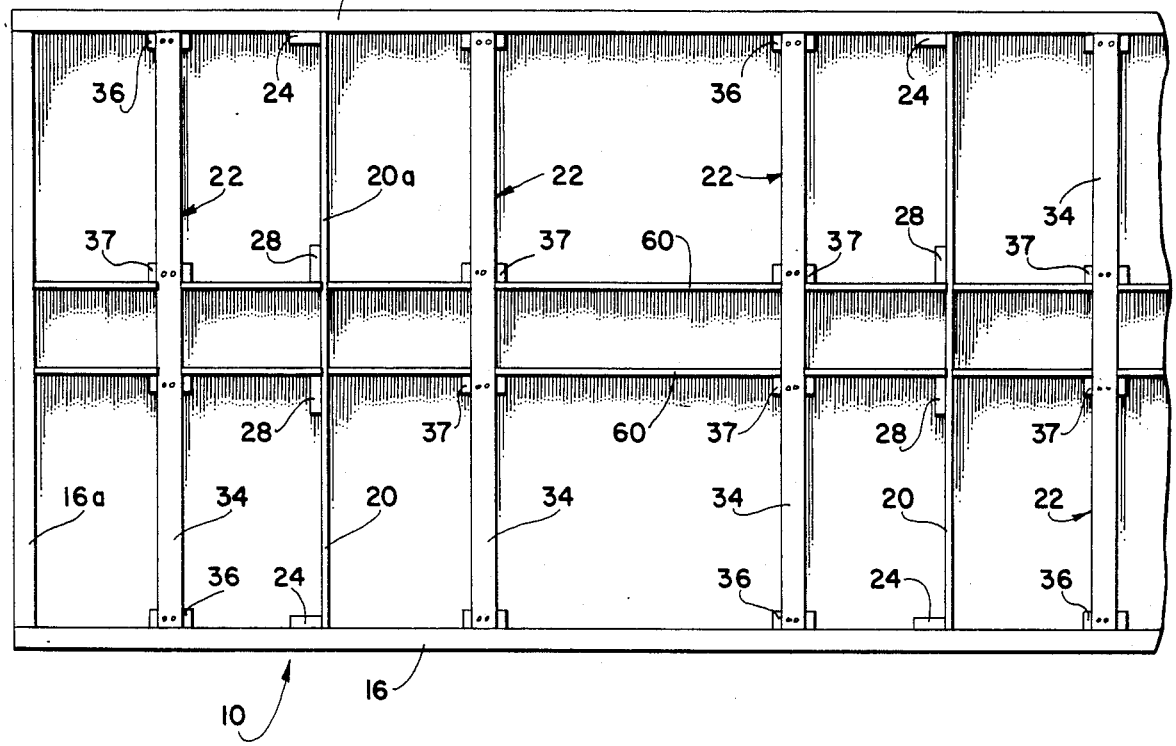
FIG. 7 is a top-plan view thereof.
Figure 6:
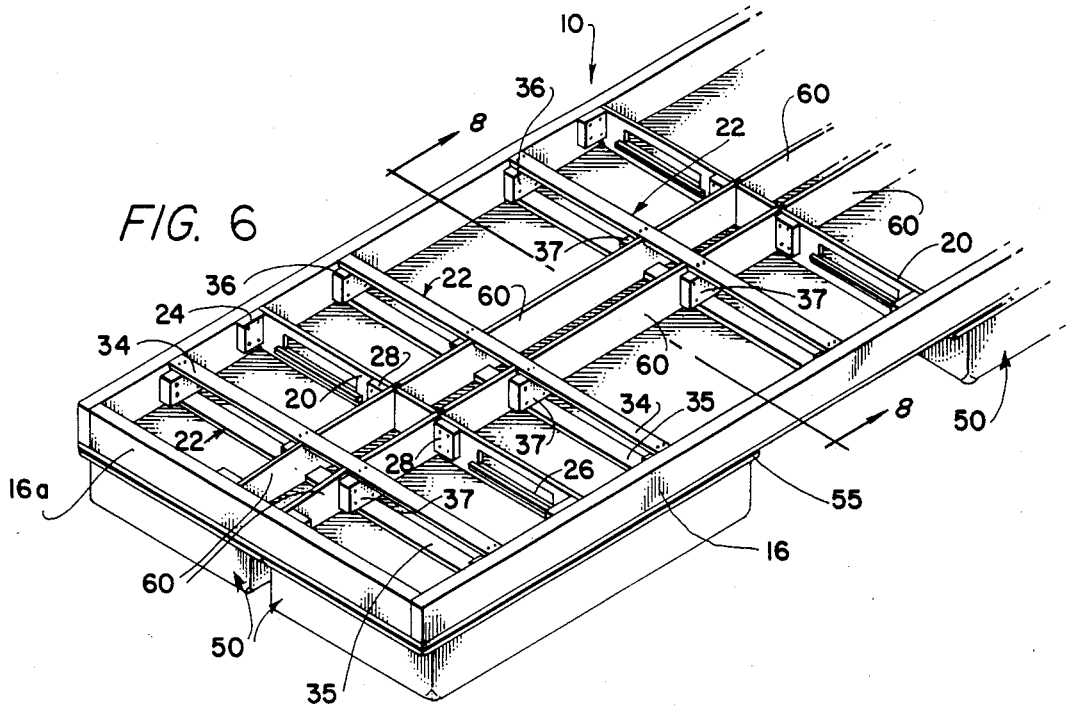
FIG. 6 is a perspective view of another embodiment of the dock assembly with the decking removed therefrom.
Figure 8:
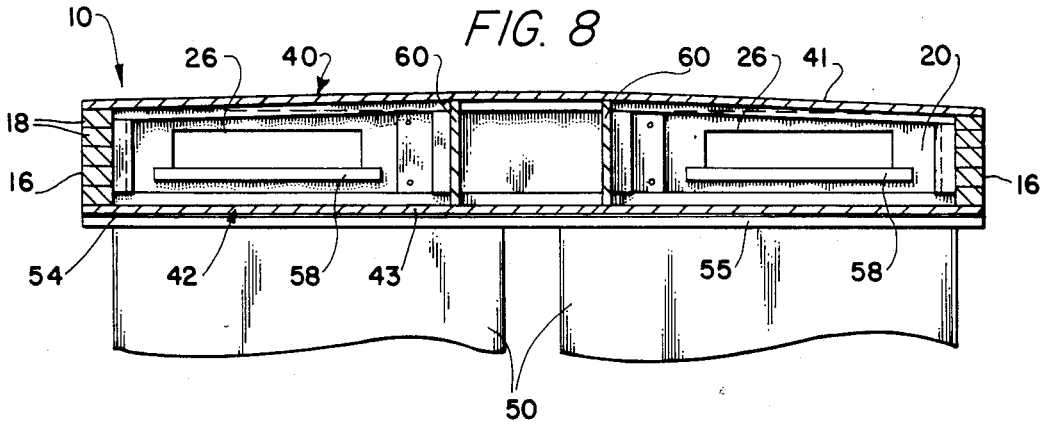
FIG. 8 is an enlarged cross-sectional view thereof taken substantially along line 8—8 of FIG. 6.

Referring now to a second embodiment which is illustrated in FIGS. 6, 7 and 8, there is shown a floating-dock frame structure that is similar to the structure described hereinbefore, but includes a longitudinal box-beam system which comprises a pair of parallel joist members 60. The joist members are spaced apart to define a box beam that is connected to the transverse web members 20 by cleats 28, and to the brace means 22 comprising struts 34 and 35. As illustrated in FIG. 8, each joist member 60 is identical in height but greater than the height of side walers 16, again establishing a crowned decking having sloping sides.

Thus, the central portion of deck 40 is formed with a crown throughout its length, both on the main walkway section and the finger sections. This structural arrangement increases and accentuates the torsion/stress resistance of the frame structure. The beams also combine with the top and bottom skins or plywood panels 41 and 43, respectively, to increase resistance to torsion stress—largely because of the fact that they are glued in contact with each other.

The invention and its attendant advantages will be understood from the foregoing description; and it will be apparent that various changes may be made in the form, construction and arrangement of the parts of the invention without departing from the spirit and scope thereof or sacrificing its material advantages, the arrangements hereinbefore described being merely by way of example; and I do not wish to be restricted to the specific forms shown or uses mentioned, except as defined in the accompanying claims.

I claim:

1. A monocoque-structured, floating, wood dock and/or marina system comprising a dock structure defined by dock sections including a main walkway section and a plurality of extended finger sections, each of said sections having a frame structure, comprising:

a pair of outer, longitudinal, wood side-beam members spaced apart in parallel relation to each other;

a plurality of transverse wood beam members selectively spaced apart between said wood side-beam members and secured thereto;

a plurality of transverse wood strut means selectively spaced apart and interposed between said transverse beam members;

a center, longitudinal, wood beam structure secured to said transverse beam members and having a greater height than said respective side-beam members;

a deck defined by a plurality of abutting wood panels fixedly secured to said frame structure to resist torsion and compression stresses and adapted to engage said center wood beam structure, whereby a continuous longitudinal crown is formed along the length of said deck to define a drain surface;

a bottom wall defined by a plurality of abutting wood panels fixedly secured in a continuous manner longitudinally along the length of said frame structure to resist torsion and compression stresses and to complete the monocoque-structure outer surface of the dock section; and a plurality of float means secured to said bottom wall along the length thereof.

2. The dock and/or marina system as recited in claim 1, wherein said longitudinal joist structure comprises a central joist beam which extends substantially along the length of said dock sections and is fixedly attached to said transverse wood beam members, said transverse strut means and said outer, longitudinal, wood side-beam members to define a monocoque structure.

3. The dock and/or marina system as recited in claim 2, wherein said longitudinal wood side beams and said transverse wood beams are formed by a plurality of glued laminated members.

4. A monocoque-structured floating dock and/or marina system as recited in claim 1, wherein said longitudinally disposed, central, joist-beam structure comprises a plurality of longitudinal wood joist members centrally positioned between said transverse wood beam members and affixed thereto, each of said transverse wood beam members having a height less than or equal to the height of said longitudinal side beams, and each of said longitudinal joist members having a height greater than said height of said longitudinal side beams, thereby defining said crowning means.

5. A floating-dock system as recited in claim 2, including:

a first means for securing said transverse wood beams to said side beams; and a second means for securing said joist members to said transverse wood beams in a contiguous end-to-end manner.

6. A floating-dock system as recited in claim 5, wherein, said deck is formed by a plurality of interconnecting, contiguous, substantially flat wood sheets secured to said longitudinal side beams and said central joist-beam structure, whereby said sheets are raised along the central longitudinal portion thereof to define a crowned deck having sloping sides, and wherein the abutting edges of said wood sheets are secured to said transverse wood strut means, providing a continuous deck throughout the length of said main walkway section and said finger sections.

7. A floating-dock system as recited in claim 6, wherein each of said transverse trut means comprises an upper wood strut and a lower wood strut, said abutting edges of said wood sheets of said decking being affixed to said upper wood strut, and the abutting edges of said bottom wall panels being affixed to said lower strut.

8. A floating-dock system as recited in claim 7, wherein said first and second securing means include a plurality of cleat members which are affixed to said transverse wood beams and said joist members by glue.

9. A floating-dock system as recited in claim 8, wherein said wood sheets of said decking and said bottom wall panel are further affixed by glue to said transverse wood beams, to said central joist-beam structure and to said outer, longitudinal, wood side beams.

10. A floating-dock system as recited in claim 9, wherein said transverse wood beam members, said central joist-beam structure, said strut members, said deck sheets and said bottom panels are formed from sheets of plywood.

11. A monocoque-structured floating dock having a plurality of dock sections including a main walkway section and a plurality of extended finger sections, each of the sections having a frame structure, comprising:

a pair of outer longitudinal side beam members spaced apart in a parallel relationship to each other and defining the outer sides of a dock section and the sides of the monocoque structure;

a central longitudinal beam member positioned between the outer side beam members;

a plurality of transverse beam members selectively spaced apart and connected to the outer side beam members and the central beam member;

a plurality of transverse strut members selectively spaced apart and interposed between the transverse beam members;

an upper deck fixedly secured to the outer side beam members and the strut members to resist torsion and compression stresses and to comprise the upper portion of the monocoque structure;

a solid bottom cover member fixedly secured to the outer side beam members and the transverse strut members to resist torsion and compression stresses and to comprise the lower portion of the monocoque structure, the monocoque structure defining a substantially closed and permanently fixed rectangular structure;

floatational means for supporting the monocoque structure; and means for connecting the floatational means beneath the bottom cover member.

12. The invention of claim 11 wherein the upper deck and the bottom cover members are afixed along their interface with the outer side beams members and the strut members with glue.

13. The invention of claim 12 wherein the side beam members are formed of a glulam configuration of a series of individual beams glued together.

14. The invention of claim 13 wherein the central longitudinal beam member is of a greater height than the side beam members and the upper deck has a non-planar central crown configuration.

15. A monocoque-structure wooden floating dock having a plurality of dock sections including a main walkway section and a plurality of extended finger sections, each of the sections having a frame structure, comprising:

a pair of outer longitudinal side wood beam members spaced apart in a parallel relationship to each other and defining the outer sides of a dock section and the sides of the monocoque structure;

a plurality of transverse wood members selectively spaced apart and connected to the outer side beam members;

a solid upper wood deck fixedly secured to the outer side beam members and the transverse members to resist torsion and compression stresses and to comprise the upper portion of the monocoque structure;

a solid bottom wood cover member fixedly secured to the outer side beam members and the transverse members to resist torsion and compression stresses and to comprise the lower portion of the monocoque structure, the monocoque structure defining a substantially closed rectangular structure;

floatational means for supporting the monocoque structure; and means for connecting the floatational means beneath the bottom cover member.

16. The invention of claim 15 wherein the upper deck and the bottom cover members are afixed along their interface with the outer side beam members and the transverse members with glue.

17. The invention of claim 16 wherein the side beam members are formed of a glulam configuration of a series of individual beams glued together.

18. The invention of claim 17 further including a central longitudinal wood beam member positioned between the side beam members and of a greater height than the side beam members whereby the upper deck has a non-planar central crown configuration resulting from the central beam member.

* * * * *